United States Patent [19]

Burns

[11] Patent Number: 4,480,536

[45] Date of Patent: Nov. 6, 1984

[54] BROCCOLI BUNCHING AND CUTTING APPARATUS

[75] Inventor: Daniel E. Burns, Camarillo, Calif.

[73] Assignee: Demco Inc., Oxnard, Calif.

[21] Appl. No.: 555,649

[22] Filed: Nov. 28, 1983

[51] Int. Cl.[3] ..... B65B 13/24; B65B 13/30

[52] U.S. Cl. ..... 100/6; 53/390; 99/546; 99/639; 100/9

[58] Field of Search ..... 99/537, 635, 637, 642, 99/643; 100/2, 5-7, 9; 53/390, 515, 441

[56] References Cited

U.S. PATENT DOCUMENTS

| | | | |
|---|---|---|---|
| 3,221,640 | 12/1965 | D'arrigo | 99/537 X |
| 3,393,633 | 7/1968 | Hoffman et al. | 100/2 |
| 3,627,300 | 12/1971 | Caveney | 100/7 X |
| 4,401,020 | 8/1983 | Brux | 100/7 |

FOREIGN PATENT DOCUMENTS

| | | | |
|---|---|---|---|
| 747347 | 2/1944 | Fed. Rep. of Germany | 100/9 |

*Primary Examiner*—Timothy F. Simone
*Attorney, Agent, or Firm*—Ralph B. Pastoriza

[57] ABSTRACT

The broccoli bunching apparatus is wholly pneumatically operated. In response to a first operation on a manual pneumatic control switch, a rubber band is pneumatically expanded in front of a central opening in a housing. Broccoli stems can then be inserted through the rubber band and the opening. A second operation of the pneumatic control switch results in the rubber band retracting about the stems and simultaneously a knife blade within the housing cutting the stems. Also, an ejector is automatically operated after a given delay time to strip the cut broccoli stems from the rubber band expander so that the apparatus is ready for repeating the operation.

8 Claims, 7 Drawing Figures

BROCCOLI BUNCHING AND CUTTING APPARATUS

FIELD OF THE INVENTION

This invention relates to produce handling apparatus and more particularly to an improved broccoli bunching and cutting apparatus.

BACKGROUND OF THE INVENTION

Apparatus for bunching broccoli is known in the art. Generally, broccoli stems are manually bunched together and a rubber band placed about the bunched stems. A housing incorporating a knife blade generally electrically operated by a solenoid is designed to receive the stems and then cut the stems when the solenoid is energized. An electric switch is provided for this purpose.

With broccoli stem cutters of the foregoing type, danger could result if an operator should insert his hand in front of the knife when the same was operated. To avoid this possibility, it has been proposed to provide two switches which are widely spaced and must be simultaneously operated to actuate the knife so that both hands of a person will be occupied and the risk of cutting a hand is minimized.

There is a need for an improved broccoli bunching and cutting apparatus wherein the same can be readily operated with the same degree of safety as the foregoing devices, but without requiring widely spaced switches. Further, such a device should be able to automatically sequentially carry out further steps in the processing of the broccoli so that minimum demands are made upon the user.

BRIEF DESCRIPTION OF THE PRESENT INVENTION

With the foregoing considerations in mind, the present invention contemplates the provision of just such an improved broccoli bunching and cutting apparatus wherein the desired safety features are realized and operations required of the operator are minimized.

In its broadest aspect, the apparatus of this invention is wholly pneumatically operated and includes a pneumatically operated rubber band expanding and retracting means; a pneumatically operated broccoli stem cutting means; and pneumatic control means connected to the pneumatically operated rubber band expanding and retracting means and pneumatically operated broccoli stem cutting means responsive to a first operation to effect expansion of the rubber band. By this arrangement, the broccoli stems can be positioned through the rubber band.

The pneumatically operated rubber band expanding and retracting means and pneumatically operated broccoli stem cutting means are also responsive to a second operation of the pneumatic control means to retract the rubber band about the broccoli stems and approximately simultaneously operate the pneumatically operated cutting means to cut the stems.

In the preferred embodiment, the pneumatically operated broccoli stem cutting means comprises a knife within a housing positioned to swing across an opening to the housing and thereby cut stems received through the opening. The rubber band expanding and retracting means is exterior of the opening so that when an operator inserts the stems through the opening and the rubber band expanding and retracting means contracts the rubber band about the stems, there is no further room in the opening through which the operator might insert his hands and thus damage the same by the knife. On the contrary, since the knife is only operated upon a second operation of the pneumatic control means and since this second operation only takes place when the stems are in position within the opening, the desired degree of safety is assured.

Also in the preferred embodiment, an ejector means is provided for ejecting the cut broccoli stems after the cutting operation itself has been completed.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
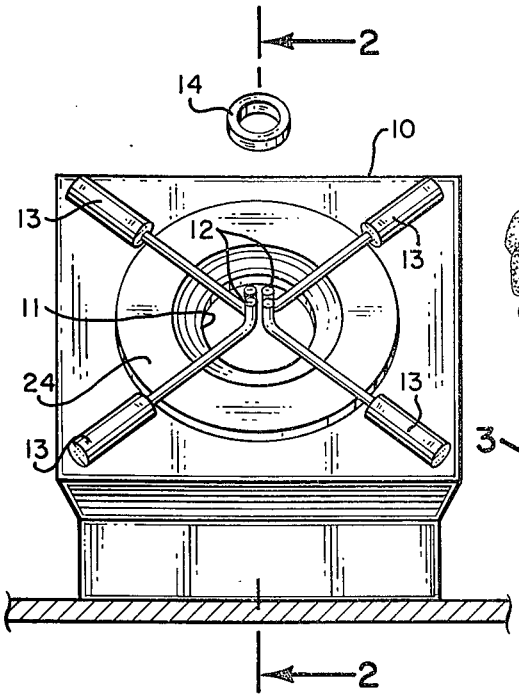
FIG. 1 is a front elevational view of the broccoli bunching and cutting apparatus of this invention.

Referring first to FIG. 1, the broccoli bunching and cutting apparatus includes a housing 10 having a front central opening 11 for receiving broccoli stems to be bunched and cut. A pneumatically operated rubber band expanding means is mounted on the housing 10 and includes fingers 12 on the ends of piston rods movable into and out of cylinders 13 from a first position overlying the outside central area of the opening 11 radially outwardly to a second position beyond the periphery of the opening. With this arrangement, a rubber band shown in exploded view in FIG. 1 at 14 can be placed over the fingers and the band then expanded.

Figure 2:
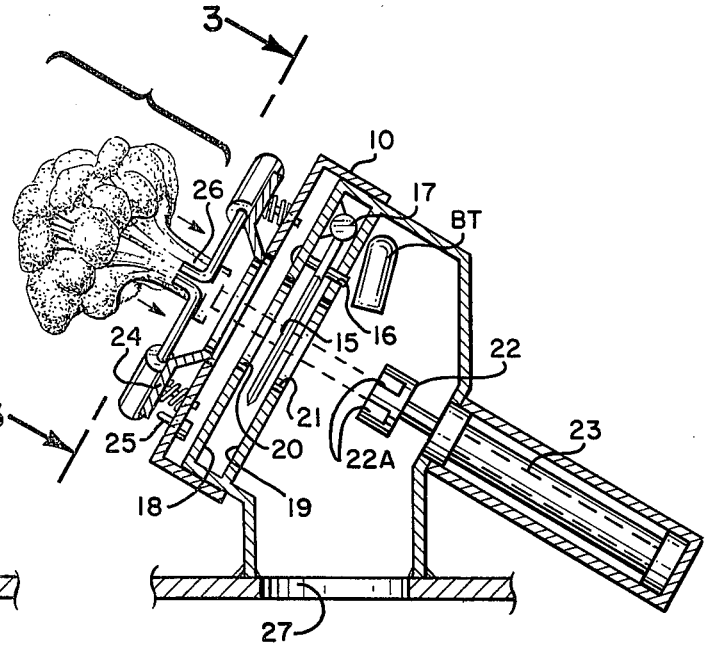
FIG. 2 is a side cross section taken in the direction of the arrows 2—2 of FIG. 1.
Figure 3:
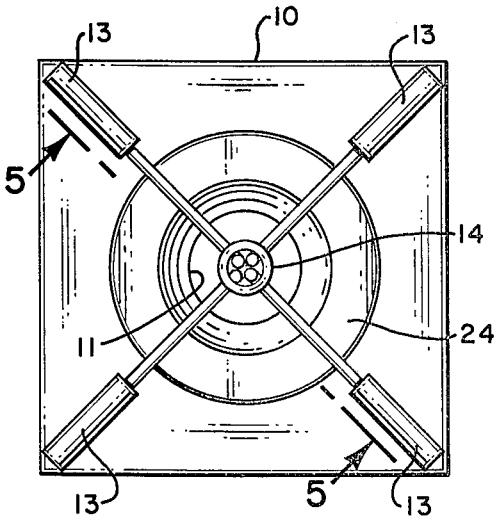
FIG. 3 is a plan view of the rubber band expanding and contracting means on the tilted front face of the apparatus of FIG. 2 looking in the direction of the arrows 3—3 and illustrating a first position of these components.
Figure 4:
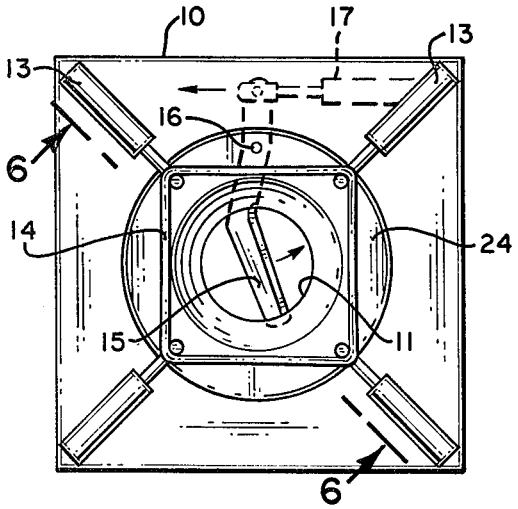
FIG. 4 is a view similar to FIG. 3 illustrating a second position of the rubber band expanding and contracting components.

The foregoing as well as further features of this invention will become evident by now referring to FIGS. 2, 3 and 4.

Considering first the side view of FIG. 2 it will be noted that there is provided a pneumatically operated knife blade 15 pivotally mounted at 16 inside the housing 10 for swinging movement from a first position in which the blade is on one side of the opening 11 to a second position in which the blade is on the other side of the opening. Towards this end, there is provided a pneumatic cylinder 17 for effecting this swinging movement of the blade about the pivot 16.

With respect to the foregoing, the housing 10 also includes in its interior a pair of closely spaced parallel walls 18 and 19 defining a slot within which the knife blade 15 swings. These walls also include openings 20 and 21, respectively aligned with each other and the front central opening 11, so that broccoli stems are held by the peripheral edges of the openings as the knife blade cuts through the stems.

Still referring to FIG. 2, there is shown a pneumatically operated ejector means in the form of an ejector head 22 on the end of a piston rod operable within a pneumatic cylinder 23. This structure is mounted in the rear of the housing in axial alignment with the opening 11.

A manually operable pneumatic switch means takes the form of a circular plate 24 mounted on the exterior of the housing in coaxial alignment with the central opening 11. Beneath the plate 24 on the lower central portion of the front of the housing is a pneumatic switch 25 as clearly shown in FIG. 2. By this arrangement, manual depression of the plate 24 will operate the switch 25.

Broccoli stems are illustrated in FIG. 2 at 26 preparatory to being inserted in the central opening 11 to be cut by the swingable knife blade 15. After the stems are cut, they are disposed of through a bottom opening 27 in the housing.

FIG. 3 illustrates in greater detail the rubber band expanding and retracting means wherein the same is in a first position for receiving the rubber band 14 over the fingers 12 as described in FIG. 1.

When pneumatic pressure is applied to the cylinders 13, the various piston rods are retracted into the cylinders to thereby assume a second position as illustrated in FIG. 4 wherein the rubber band 14 is expanded beyond the periphery of the opening 11.

Figure 5:
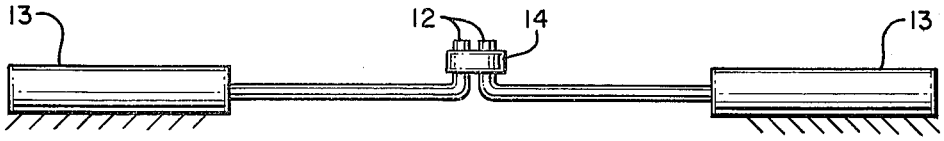
FIG. 5 is a fragmentary view looking in the direction of the arrows 5—5 of FIG. 3.
Figure 6:
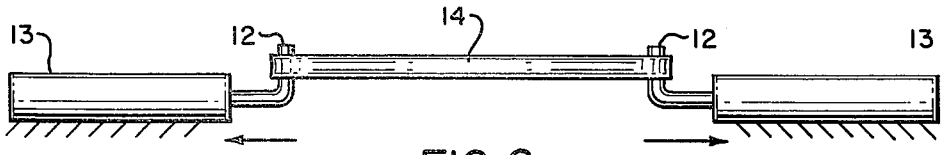
FIG. 6 is a fragmentary view looking in the direction of the arrows 6—6 of FIG. 4; and, FIG. 7 is a schematic block diagram illustrating the sequential operation of various pneumatic cylinders in accord with the invention.

FIG. 5 more clearly illustrates the rubber band 12 about the fingers 14 in the first position of these fingers while FIG. 6 shows the expanded position.

Figure 7:
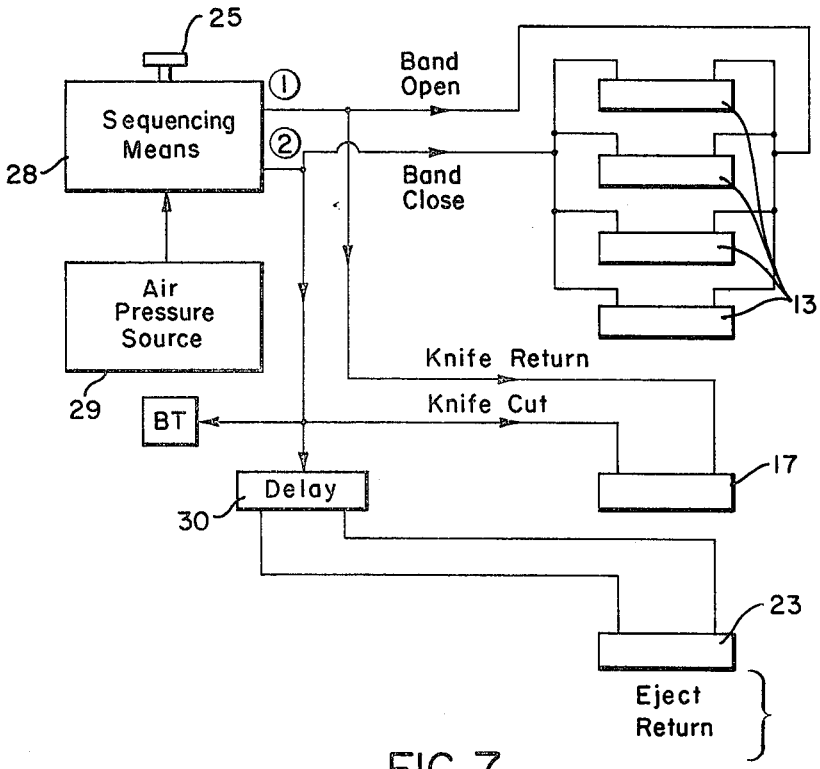

Referring now to FIG. 7, there is schematically depicted the manual pneumatic switch 25 described in FIG. 2 in the upper left portion of FIG. 7. This switch operates a sequencing means indicated by the numeral 28 for sequentially applying air pressure from a source 29 to the various cylinders described in FIGS. 1 and 2. Briefly, when the pneumatic switch 25 is first operated, pneumatic pressure will pass from the air pressure source 29 through path number 1 identified by the numeral 1 with a circle around it in FIG. 7. Thus air pressure will operate the cylinders 13 to expand the rubber band and also will be passed to the cylinder 17 to move the knife blade 15 from a first to a second position. Upon a second operation of the pneumatic switch means 25, air pressure from the source 29 will be passed along path number 2 identified by the numeral 2 with a circle around it to thereby operate the pneumatic cylinders 13 in an opposite direction to retract or close the rubber band about the broccoli stems and also to move the knife from its second back to its first position to effect a cutting operation. In response to this latter operation, a delay 30 is introduced prior to the application of pneumatic pressure to the ejector cylinder 23 described in FIG. 2.

OPERATION

From the foregoing description, the overall operation of the broccoli bunching and cutting apparatus will become evident.

Initially, the fingers 12 of the rubber band expanding and retracting means described in FIGS. 1 and 3 through 6 will be in their first or closed position as illustrated in FIGS. 1, 3 and 5.

An operator will then select a rubber band 14 and insert it over the four fingers of the four piston rods associated with the cylinders 13.

The operator will then depress the switch plate 24 to thereby operate the pneumatic switch 25.

In response to this first operation of the pneumatic switch the fingers will move to their second position to expand the rubber band 14. Also, the knife blade 15 will be returned from its first position to its second position preparatory to effecting a cutting operation.

The apparatus will remain dormant at this point until such time as broccoli stems 26 as shown in FIG. 2 are inserted through the expanded rubber band and opening 11 and the switch 24 again depressed to operate the pneumatic switch 25 a second time. In response to operation of the pneumatic switch a second time, the fingers 12 will return to their first positions so that the rubber band now encircles the stems 26 and bunches the broccoli. Simultaneously, the knife blade 15 will swing from its second position to its first position to cut the stems extending into the housing beyond the path of the knife blade. The delay 30 described in FIG. 7 will delay operation of the ejector 22 until it is assured that the knife blade has reached its first position. Operation of the ejector 22 by pneumatic pressure applied to the cylinder 23 will strip the broccoli free of the fingers and the apparatus itself so that the apparatus is in condition for a repeat operation, the ejector 22 returning automatically to its first position illustrated in FIG. 2. As described heretofore, the cut broccoli stems are disposed of through the opening 27.

With respect to the above described ejector operation, the ejector has a front surface with crossed grooves shown at **22*a* in FIG. 2 oriented at 90° to each other. This positioning corresponds to the 90° orientation of the piston rods supporting the fingers 12 extending from the cylinders 13 as shown in FIG. 3** so that stripping of the broccoli stems by the ejector from the fingers when in their closed position is assured.

With the ejection of the bunched broccoli completed and the cut stems disposed of through the opening 27, the apparatus is now in the same condition it was initially as illustrated in FIG. 1 preparatory to receiving another rubber band 14 and expanding the same to receive additional broccoli stems.

In FIG. 4, the knife blade 15 and associated arrow indicate movement of this blade from its first to its second position while the rubber band 14 is being expanded. The knife blade is thus in proper position preparatory to moving back from its second to its first position and effecting the cutting operation as described.

As mentioned, the cutting knife itself operates between spaced parallel walls defining a slot through which the knife swings so that a clean cut of the broccoli results, the stems being held by the inner peripheries of the aligned openings of these walls. This feature is important since in prior art cutters, without such a slot arrangement, the knife blade especially after prolonged use would tend to simply wipe past the stems or push them aside rather than cut through the same.

From all of the foregoing, it will now be evident that the present invention has provided a greatly improved broccoli buncher and cutter. The requirement of a successive dual operation of the pneumatic switch before the knife is operated assures that the fingers will be in position covering the opening 11 so that the chance of an operator inserting his hand in the opening when the knife operates is minimized.

By providing the large actuating plate 24 described in FIGS. 1 and 2 for actuating the pneumatic switch 25, the operation of the switch is very simply manually carried out by an operator and he need only insert the rubber band 14 about the fingers and then push the plate, insert the broccoli and push the plate a second time. These operations are successively repeated for subsequent broccoli brought in from the field. Because of the large area of the switch actuating plate, it is very easy for the operator to operate the pneumatic switch. In fact, for the second operation of the switch, the plate itself may be pushed automatically by the broccoli itself when the stems are fully inserted in the opening.

As an optional feature, an air jet generator such as a blow tube shown at BT in FIG. 2, may be provided to blow the cut stems away from the opening 21 and towards the exit opening 27 so that the ejector 22 can operate without interference with the stems. In this respect, the blow tube BT can be operated at about the same time as the knife cut operation as indicated in FIG. 7 so that the stems are immediately removed as they are being cut.

Changes falling within the scope and spirit of this invention will occur to those skilled in the art. The broccoli bunching and cutting apparatus is therefore not to be thought of as limited to the specific embodiment set forth for illustrative purposes.

I claim:

1. A broccoli bunching and cutting apparatus including, in combination:

(a) a housing having a front central opening for receiving broccoli stems to be bunched and cut;

(b) pneumatically operated rubber band expanding and retracting means mounted on the exterior of said housing about said opening and including separate pneumatic cylinders with pistons terminating in fingers movable from a first position overlying the outside central area of said opening, radially outwardly to a second position beyond the periphery of said opening so that a rubber band placed on said fingers when in said first position is expanded when the fingers move to said second position;

(c) pneumatically operated broccoli stem cutting means; and (d) pneumatic control means connected to said pneumatically operated rubber band expanding and retracting means and pneumatically operated broccoli stem cutting means responsive to a first operation to effect expansion of a rubber band so that broccoli stems can be positioned through the rubber band; and responsive to a second operation to retract the rubber band about the broccoli stems and approximately simultaneously operate said pneumatically operated cutting means to cut said stems.

2. A broccoli bunching and cutting apparatus according to claim 1, in which said pneumatically operated broccoli cutting means is supported within said housing and includes a knife blade swingable across said opening so that broccoli stems inserted through said opening will be cut.

3. A broccoli bunching and cutting apparatus according to claim 1, including, in combination, ejector means for stripping said broccoli from said pneumatically operated rubber band expanding and retracting means after said rubber band has been retracted about said broccoli in response to completion of the cutting of the broccoli stems; and delay means for providing a short time interval between the completion of the cutting of the broccoli stems and the initiation of said ejector means.

4. A broccoli bunching and cutting apparatus, including, in combination:

(a) a housing having a front central opening for receiving broccoli stems to be bunched and cut;

(b) a pneumatically operated rubber band expanding means mounted on said housing and including separate pneumatic cylinders with pistons terminating in fingers movable from a first position overlying the outside central area of said opening, radially outwardly to a second position beyond the periphery of said opening so that a rubber band placed on said fingers when in said first position is expanded when the fingers move to said second position;

(c) a pneumatically operated knife blade mounted inside said housing for swinging movement from a first position in which the blade is on one side of said opening to a second position in which said blade is on the other side of said opening;

(d) pneumatically operated ejector means mounted in the rear of the housing in axial alignment with said opening;

(e) manually operable pneumatic switch means;

(f) a source of air pressure connected to said switch means;

(g) pneumatic sequencing means connecting said switch means to said pneumatically operated rubber band expanding means and said pneumatically operated knife blade, said sequencing means being responsive to a first operation of said pneumatic switch means to cause air pressure from said source to move said fingers from their first position to their second position and to simultaneously move said knife blade from its first to its second position, said pneumatic sequencing means being responsive to a second operation of said pneumatic switch means to move said fingers from their second position back to their said first position and simultaneously swing said knife blade from its second position across the opening back to its said first position; and (h) pneumatic delay means connected between said sequencing means and said pneumatically operated ejector means responsive to said second operation of said switch means to actuate said ejector after a given delay period whereby a rubber band can be placed on said fingers when in their said first position and expanded in front of said opening to their said second position and said knife blade moved to its said second position by a first operation of said switch means and broccoli stems then positioned through said opening to extend into said housing, and said switch means thereafter operated a second time to cause said fingers to return to their first positions so that said rubber band now encircles said stems and bunches said broccoli, said knife blade simultaneously moving from its said second position to its said first position to cut the stems extending into said housing beyond the path of said knife blade, said delay means delaying operation of said ejector means until said knife blade reaches its said first position after which delay said ejector means is automatically operated to strip the remaining bunched broccoli stems from said fingers, so that the bunched broccoli is free of said apparatus and said apparatus itself is in condition for a repeat operation.

5. An apparatus according to claim 4, in which said housing includes in its interior a pair of closely spaced parallel walls defining a slot within which said knife blade swings, said walls having openings aligned with said front central opening so that broccoli stems are held by the peripheral edges of said openings as said knife blade cuts through the stems.

6. An apparatus according to claim 4, in which there are provided four fingers for movement along radial paths spaced at 90° from each other, said ejector having a front surface with crossed grooves positioned to register with and receive said fingers when ejecting said broccoli to thereby effect the stripping of the broccoli from said fingers.

7. An apparatus according to claim 4, in which said housing includes a lower outlet opening through which stem portions cut by said knife can pass and ultimately be disposed of.

8. An apparatus according to claim 4, in which said housing further includes jet air generating means responsive to said second operation of said switch means to blow out broccoli stems away from interference with said ejector means.

* * * * *